United States Patent [19]

Cullis et al.

[11] 4,316,576

[45] Feb. 23, 1982

[54] METHOD AND CHAMBER FOR SEPARATING GRANULOCYTES FROM WHOLE BLOOD

[75] Inventors: Herbert M. Cullis; Luiz F. Gutierrez, both of Silver Spring, Md.

[73] Assignee: Baxter Travenol Laboratories, Inc., Deerfield, Ill.

[21] Appl. No.: 204,724

[22] Filed: Nov. 6, 1980

[51] Int. Cl.[3] ..... B04B 5/02

[52] U.S. Cl. ..... 233/26; 128/214 D

[58] Field of Search ..... 233/26, 14 R, 12, 16, 233/21, 19 R, 19 A, 27, 22, 10; 128/214 R, 214 D, 214 A, 214 B, 214 C, 214 E, 214 F; 150/8, 1

[56] References Cited

U.S. PATENT DOCUMENTS

| | | | |
|---|---|---|---|
| 3,788,374 | 1/1974 | Saijo | 150/8 |
| 4,146,172 | 3/1979 | Cullis | 128/214 |
| 4,185,629 | 1/1980 | Cullis | 233/14 R |
| 4,187,979 | 2/1980 | Cullis | 233/14 R |

*Primary Examiner*—Robert W. Jenkins

*Attorney, Agent, or Firm*—Robert A. Benziger; Thomas R. Vigil; Paul C. Flattery

[57] ABSTRACT

The method for separating whole blood into the components thereof is practiced with and within a separation chamber mounted in a centrifuge device during centrifugation of the chamber, the chamber having inner and outer wall surfaces and first and second side edges. The method comprises the steps of: arranging and configuring the chamber such that it has (a) an inlet on the first side thereof through which whole blood is received, (b) a first upper outlet at the top of the chamber from which plasma with particles therein is withdrawn, (c) a second lower outlet at the bottom corner of the chamber on the second side thereof from which red blood cells are withdrawn, and (d) the inner wall surface positioned in a plane including a tangent to a circle about the axis of rotation and the plane positioned about normal (in a vertical direction) to a radius extending from the axis of rotation of the centrifuge device. The method and chamber direct whole blood into the chamber from the first side thereof at a point between the bottom and top of the chamber. Heavier particles such as red blood cells are directed downwardly and outwardly along the outer wall surface toward the lower bottom corner of the chamber. At the same time, plasma is directed upwardly along the inner wall surface of the chamber, so that there is separation of white blood cells, particularly granulocytes, from the whole blood, which are directed with the plasma, toward and out the first outlet from the chamber.

79 Claims, 10 Drawing Figures

METHOD AND CHAMBER FOR SEPARATING GRANULOCYTES FROM WHOLE BLOOD

BACKGROUND OF THE INVENTION

1. Field of the Invention

The present invention relates to a method and chamber for separating granulocytes from whole blood. More specifically, the present invention relates to a specific configuration of a chamber and the orientation of the chamber for providing enhanced separation of granulocytes from whole blood while whole blood is undergoing centrifugal force within the chamber.

2. Description of the Prior Art

Heretofore methods and apparatus for taking whole blood from a source, such as a donor, and centrifuging the blood within a separation chamber for separating the whole blood into components thereof and then collecting one or more components of the blood, followed by recombining the remaining components and returning the recombined blood to the donor, have been proposed. Examples of such methods and apparatus are disclosed in the following U.S. Patents:

| U.S. PAT. NO. | PATENTEE |
|---|---|
| 4,146,172 | Cullis et al. |
| 4,185,629 | Cullis et al. |
| 4,187,979 | Cullis et al. |

U.S. Pat. No. 4,146,172 is directed to: Centrifugal Liquid Processing System wherein there is disclosed and claimed a particular configuration for a blood separation chamber and for platens with mating cavities therein within which a flexible plastic receptacle is received so as to form a blood separation chamber therein having the configuration of the mating cavities.

U.S. Pat. No. 4,185,629 is directed to: Method and Apparatus for Processing Blood and discloses a method and apparatus for separating whole blood into its components and a separation chamber of the type disclosed and claimed in U.S. Pat. No. 4,146,172.

In the blood separation chamber disclosed in U.S. Pat. Nos. 4,146,172 and 4,185,629 whole blood is introduced into the chamber at the bottom thereof, red blood cells are removed from opposite top edges of the chamber which are disposed at approximately the same radius from the axis of rotation of a centrifuge device in which the chamber is mounted, and platelet rich plasma is removed from the top center portion of the chamber which is located at a shorter radius from the axis of rotation of the centrifuge device.

U.S. Pat. No. 4,187,979 directed to: Method and System for Fractionating a Quantity of Blood into the Components Thereof discloses a method and system for separating whole blood into red blood cells, white blood cells, platelets and plasma. The method and system also provide collection chambers, either within the centrifuge device or outside the centrifuge device, for collecting white blood cells, platelets and plasma. In this device, a generally square separation chamber positioned in the centrifuge device in a diamond position is disclosed with whole blood being introduced into one side corner of the chamber and red blood cells being withdrawn from the other side corner of the chamber. Plasma with white blood cells and platelets is withdrawn from the top corner of the chamber and is circulated through a white blood cell separation chamber and then through a platelet separation chamber within the centrifuge device. Then, the plasma withdrawn from the platelet separation chamber is returned to the bottom corner of the separation chamber so that it is passed upwardly through the square separation chamber thereby to elute white blood cells and platelets from the whole blood and red blood cells flowing across the blood separation chamber.

The apparatus disclosed in each of the three patents identified above utilize an optical spill detector or sensor which senses the optical density of the plasma being withdrawn from the whole blood separation chamber so that the amount of red blood cells being withdrawn with the plasma can be monitored and controlled in a manner as disclosed in these patents. Also, a specific optical detector for use in the apparatus disclosed in these three patents is disclosed and claimed in U.S. Pat. No. 4,227,814.

The disclosures of U.S. Pat. Nos. 4,146,172; 4,185,629; 4,187,979; and 4,227,814 are incorporated herein by reference.

In the separation of whole blood into the components thereof as taught in the patents identified above, whole blood is pumped into the separation chamber undergoing centrifugation at a given volumetric rate and plasma containing platelets and/or white blood cells is withdrawn at another volumetric rate. The rate of withdrawal of plasma is increased until the optical density thereof exceeds a certain level indicating that a certain quantity of red blood cells is being withdrawn with the plasma. Then the pump for withdrawing plasma is reversed to return a predetermined amount of plasma with red blood cells mixed therein to the separation chamber, the volumetric displacement of the plasma pump is reduced and reversed to its original pumping direction and the plasma pump re-energized to repeat this procedure until a certain amount of whole blood has been processed. In this way, plasma rich with platelets and/or white blood cells is withdrawn from the blood separation chamber with little or minimal contamination thereof with red blood cells. However, because of the nature of whole blood, the granulocyte cells of the white blood cells were not efficiently separated from the red blood cells.

Separation of white blood cells, particularly granulocytes, from the whole blood was improved by passing whole blood/red blood cells through a blood separation chamber undergoing centrifugation from one side thereof to the other side thereof while at the same time passing plasma through the separation chamber from the bottom thereof to the top thereof so that the plasma served to elute white blood cells, such as granulocytes, from the red blood cells. A method and system providing for such cross-flows of whole blood/red blood cells and plasma in a blood separation chamber is disclosed in U.S. Pat. No. 4,187,979 referred to above.

As will be described in greater detail hereinafter, the method and separation chamber of the present invention provide for more efficient separation of white blood cells, particularly granulocytes, from whole blood than was obtained from the previous methods, apparatus and systems. The better separation of granulocytes from whole blood is achieved, in accordance with the teachings of the present invention, by the particular configuration and orientation of the blood separation chamber.

Also according to the teachings of the present invention, the blood separation chamber is formed from two mating cavities disposed respectively in inner and outer platens which are releasably received in a platen, holder and latch assembly for securing the platens in place in a centrifuge device. The particular platen, holder and latch assembly is of the type disclosed in copending application Ser. No. 102,747 filed on Dec. 12, 1979 for: Platen, Holder and Latch Assembly for Securing Platens in Place within a Centrifuge Device, now U.S. Pat. No. 4,266,717, the disclosure of which is incorporated herein by reference.

Further as will be described in greater detail hereinafter, the separation chamber of the present invention is configured and arranged so that whole blood enters the chamber from one side thereof between the bottom and top of the chamber and in a way so that red blood cells are directed downwardly and outwardly to a bottom corner of the chamber and plasma with white blood cells and platelets therein is directed upwardly out a top center exit port from the chamber.

SUMMARY OF THE INVENTION

According to the invention there is provided a method for separating whole blood into the components thereof within a separation chamber mounted in a centrifuge device during centrifugation of the chamber, the chamber having inner and outer wall surfaces and first and second side edges, said method comprising the steps of arranging and configuring the chamber such that it has (a) an inlet on the first side thereof through which whole blood is received, (b) a first upper outlet at the top of the chamber from which plasma with particles therein is withdrawn, (c) a second lower outlet at the bottom corner of the chamber on the second side thereof from which red blood cells are withdrawn, and (d) the inner wall surface positioned in a plane including a tangent to a circle about the axis of rotation and the plane positioned about normal (in a vertical direction) to a radius extending from the axis of rotation of the centrifuge device; directing whole blood into the chamber from the first side thereof at a point between the bottom and top of the chamber; directing heavier particles such as red blood cells downwardly and outwardly along the inner wall surface of the chamber, so that there is separation of white blood cells, particularly granulocytes, from the whole blood, which are directed with the plasma, toward and out the first outlet from the chamber.

Further according to the invention there are provided blood processing means for receiving whole blood therein for the centrifugation of the blood therein to effect separation of the blood into components thereof, said means being positionable within a centrifuge device on a tangent of a circle about the axis of rotation of the device and releasably fixed in that position for rotation about the axis, said means having a blood separation chamber therein situated between an inner wall surface and an outer wall surface of said chamber and between a top and bottom and first and second side edges of said chamber, said inner wall surface facing away from the axis and being in a plane which is generally tangent to circles about the axis and which extends upwardly from a bottom tangent line at a first radius toward the axis of rotation at a slight angle to said first radius, said outer wall surface being generally parallel spaced from and facing said inner wall surface, inlet port means for directing whole blood into said chamber at a point on said first side edge thereof between the top and bottom of said chamber, first outlet port means opening into said chamber at the top of said chamber for the withdrawal of plasma from said chamber and second outlet port means opening into said chamber at a bottom corner thereof at the bottom of said second side edge of said chamber, said outer wall surface being configured and arranged to direct heavier particles, such as red blood cells, outwardly from said first side edge to said second side edge and simultaneously downwardly toward said lower bottom corner during rotation of said chamber about the axis so that such heavier particles can be withdrawn out of said second outlet means, and the upper portions of said first and second side edges adjacent said inner wall surface being configured to converge toward said first outlet means to direct plasma out of said chamber and thereby obtain separation of white blood cells, particularly granulocytes, from the whole blood, which are directed with the plasma toward and out said first outlet means from said chamber.

Further according to the invention there is provided a flexible generally rectangular bag formed from two plies of flexible material sealed around the edges thereof for receiving whole blood therein for separation of the whole blood into components thereof when said flexible bag is received and clamped between two platens of a platen assembly and rotated therewith in a centrifuge device with each platen having a cavity therein configured to mate with the cavity in the other platen to define together a blood separation chamber in said bag, said flexible bag having a top side port in the top edge adjacent one side edge with a tubing extending therefrom which functions as an exit port for red blood cells, a top central port in the top edge with a tubing extending therefrom forming an exit port for plasma and white cells, and a top mid-central port in the top edge on the other side of the top center port with a tubing extending therefrom which functions as an inlet port for whole blood, a first passageway formed between said two plies as a result of at least one ply being received in a first groove formation in one platen extending between said top mid-central port and a point between the bottom and top of the separation chamber formed within said bag so that whole blood entering into said top mid-central port and first passageway is directed by said first passaageway into the separation chamber within the bag at one side of said chamber and between the top and bottom of said chamber, a second passageway formed between said two plies as a result of at least one ply being received in a second groove formation formed in one platen and extending between said top side port and a bottom corner of said separation chamber on the other side of said chamber so that red blood cells directed to the lower corner exit out the second passageway and said top side port, said plies of said bag being movable into said cavities to form a separation chamber having the configuration of said cavities by the pressure of whole blood being pumped into the separation chamber as the chamber is being rotated to subject the whole blood therein to centrifugal force, the configuration and orientation of the separation chamber formed within the bag serving to separate plasma and white cells from the red cells within said bag, and said bag being disposable such that the mating cavities defining the separation chamber in the bag clamped therebetween can be quickly reused without special cleaning thereof.

Still further according to the invention there is provided for use in a platen assembly of the type which includes an inner platen, an outer platen and a flexible receptacle clamped therebetween and which is positionable on a tangent in a centrifuge device and releasably fixed in that position for rotation about the axis of rotation of the device, an outer platen having an inner surface which faces toward the axis, said inner surface having a cavity therein which has first and second side edges and a curved wall surface extending from said first edge into said platen and to said second side edge and having a top and a bottom, said cavity being configured, when a wall of a flexible receptacle is positioned thereagainst, to direct whole blood entering the receptacle into said cavity within the receptacle at a point on said first side edge of said cavity between said top and bottom thereof and to direct red blood cells toward a lower corner of said cavity at the junction between said bottom and said lower end of said second side edge of said cavity.

Still further according to the invention there is provided for use in a platen assembly of the type which includes an inner platen, an outer platen and a flexible receptacle clamped therebetween and which is positionable on a tangent of a circle in a centrifuge device and releasably fixed in that position for rotation about the axis of rotation of the device, an inner platen having an inner surface which faces away from the axis, said inner surface having a cavity therein which has a top and a bottom and first and second side edges, and a planar surface extending between said top and bottom and said side edges, the upper portion of said first and second side edges of said cavity converging toward the top of said cavity which has a recess formation therein forming an outlet from said cavity so that such converging upper portions of said first and second side edges, when a wall of a flexible receptacle is received within said cavity, will serve to direct and facilitate flow of plasma carrying white blood cells, particularly granulocytes, upwardly to the top of said cavity.

DESCRIPTION OF THE PREFERRED EMBODIMENT

Figures 1, 2:
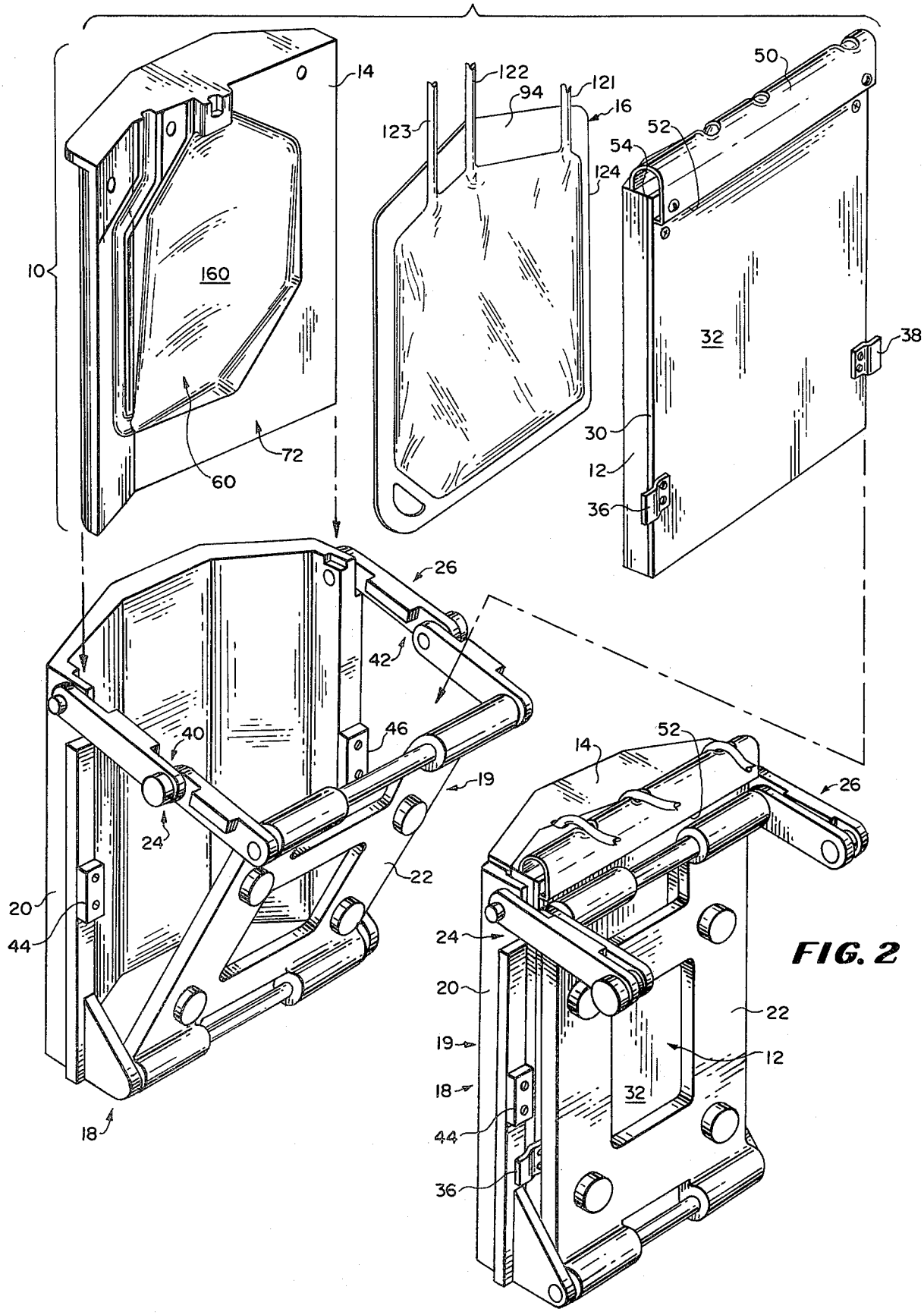
FIG. 1 is an exploded perspective view of a platen assembly in which the chamber of the present invention is formed and a platen, holder and latch assembly in which the platen assembly is received and releasably fixed in place within a centrifuge device.
FIG. 2 is a perspective view of the platen assembly fixed within the platen, holder and latch assembly shown in FIG. 1.

Referring now to the drawings in greater detail, there is illustrated in FIG. 1 a platen assembly 10 comprising an inner platen 12, an outer platen 14 and a flexible plastic bag or receptacle 16 situated therebetween. As shown, the platen assembly 10 is releasably received in a platen holder and latch assembly 18 which is of the type disclosed in copending U.S. Application Ser. No. 102,747 for: Platen, Holder and Latch Assembly for Securing Platens in Place Within a Centrifuge Device, the disclosure of which is incorporated herein by reference.

As shown, the assembly 18 includes a holder portion 19 comprising an outer wall 20 and an inner wall 22 which is pivotably connected to the bottom of the outer wall 20. Also the assembly 18 includes first and second linkages 24 and 26 which are movable between an extended position shown in FIG. 1 and a closed position shown in FIG. 2. In the extended position the parts 12, 14 and 16 of the platen assembly can be easily inserted within the holder 19. Then, the linkages 24 and 26 are articulated to move the inner wall 22 against the inner platen 12 to clamp the two platens 12 and 14 together with the receptacle 16 therebetween.

Figure 3:
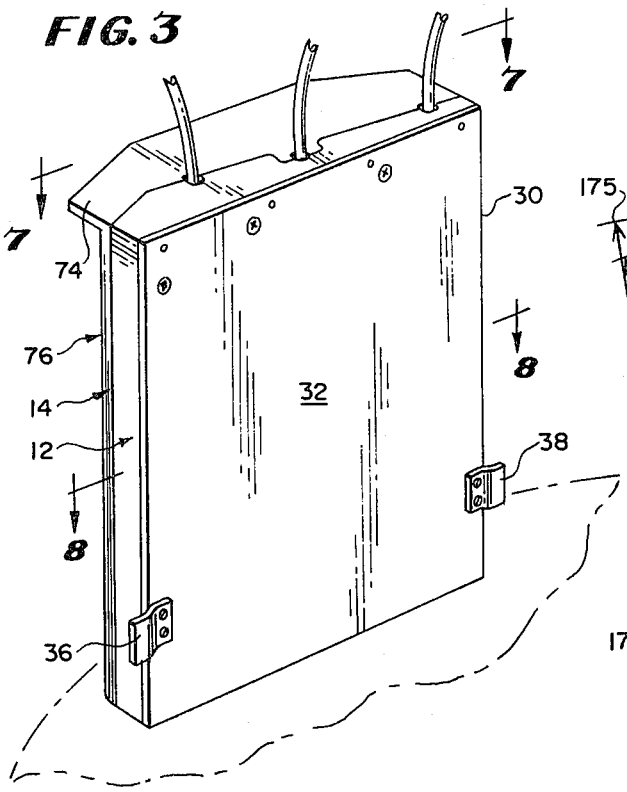
FIG. 3 is an elevational perspective view of the platen assembly shown in FIG. 2 with the platen, holder and latch assembly removed.
Figure 6:
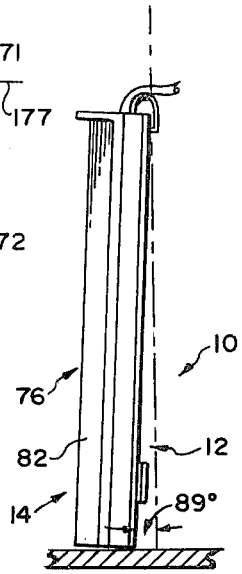
FIG. 6 is a side elevational view of the platen assembly shown in FIG. 3 and shows the angle of tilt of the platen assembly relative to a vertical line parallel to the axis of rotation of the centrifuge device.

As shown in FIGS. 1, 3 and 6, the inner platen 12 has a metal plate 30 secured to the back side thereof which plate 30 has an outer wall surface 32 which is positioned within the holder 19 so as to face the axis of rotation of the centrifuge device (not shown). Also, to facilitate mounting of the inner platen 12 in the holder 19, first and second wings 36 and 38 are secured to the lower side margins of the outer surface 32 as best shown in FIGS. 1 and 3. These wings 36 and 38 are received through spaces 40 and 42 provided by the linkages 24 and 26 in the open position and then are positioned within the holder 19 beneath stops 44 and 46 mounted to side edges of the back wall 20. In this way, removal of the inner platen 12 and the cooperating mating outer platen 14 from the holder 19 is prevented.

Also, the inner platen 12 has a upper flange member 50 mounted thereto which has a shoulder 52 extending outwardly from the outer wall surface 32 beneath a top edge 54 of the inner platen 12. The shoulder 52 is adapted to rest on the top of the holder 19 when it is in the closed position shown in FIG. 2 for limiting inward movement of the inner platen 12 into the holder 19.

The inner platen 12 has an inner surface 56 (FIG. 4) which includes a large planar portion 58 in which is formed a cavity 60 to be described in greater detail hereinafter and a narrow wall portion 62. The large inner surface portion 58 extends from a first edge 64 of the inner platen 12 at a short distance from the outer surface 32 at an angle away from the outer wall surface 32 to a line 66 defining the junction between the large planar portion 58 and the narrow planar portion 62. Then the narrow planar inner surface portion 62 extends at an angle from the line 66 toward the outer wall surface 32 and to a second edge 68 of the inner platen 12. With this configuration, the inner surface 56 of the inner platen 12 is irregular and non-parallel to the outer surface 32 and non-parallel to a tangent on which the platen assembly 10 is positioned. This facilitates removal of the plastic bag/receptacle 16 from the platen assembly 10 after it has been clamped between the inner platen 12 and the outer platen 14 and whole blood has been centrifuged within a separation chamber defined within the bag 16 and by the configuration of the cavity 60 extending into the inner surface 56 of the inner platen 12 and a mating cavity 70 in inner surface 72 of the outer platen 14.

Figure 4:
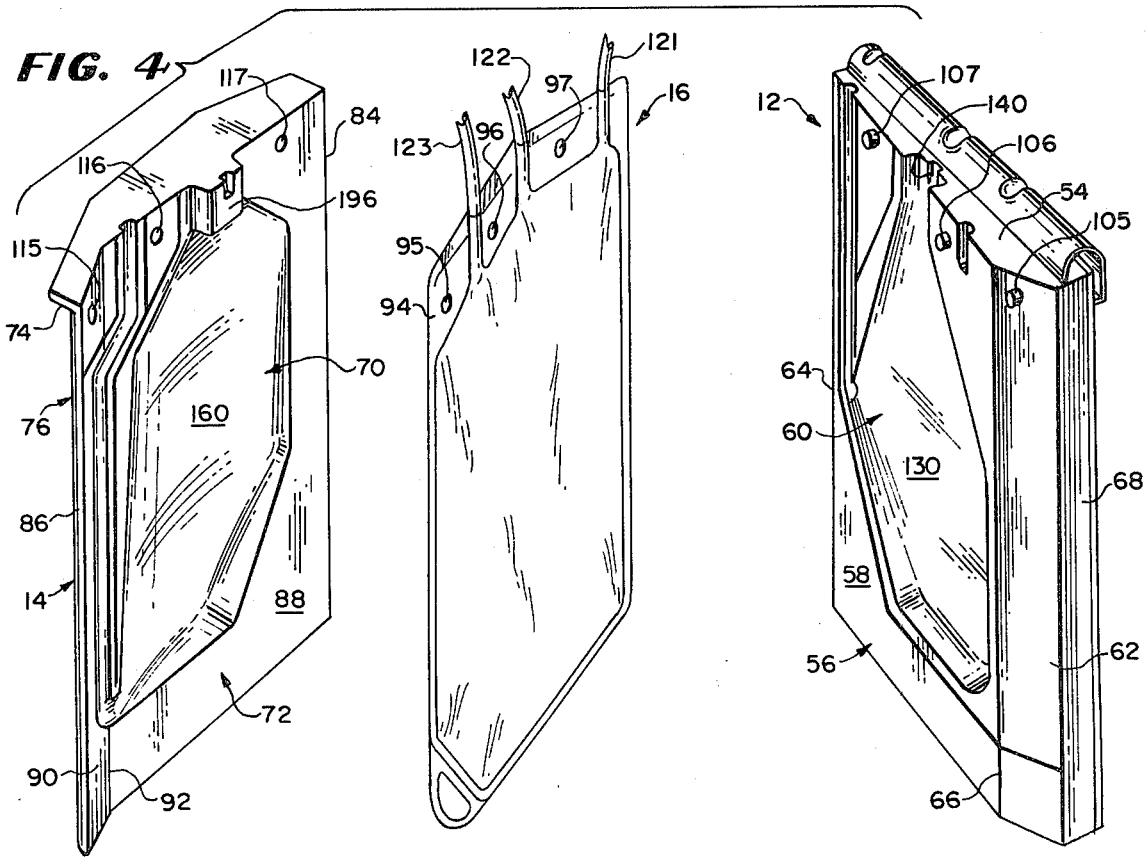
FIG. 4 is an exploded opened view of the platen assembly shown in FIG. 1 with the inner platen turned outwardly to show clearly the cavities in the inner and outer platens of the assembly and the flexible plastic bag situated therebetween.
Figure 7:
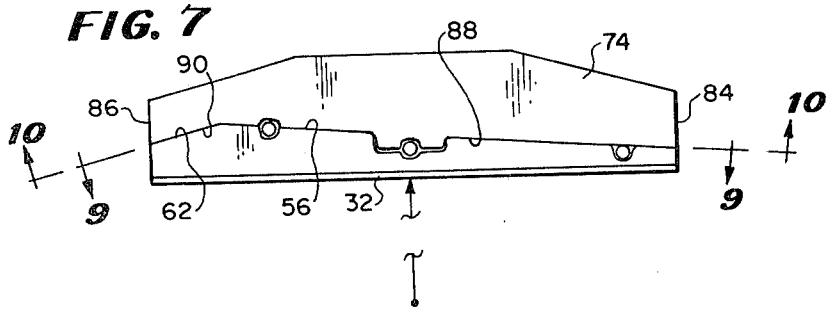
FIG. 7 is a top view of the platen assembly taken along line 7—7 of FIG. 3.
Figure 8:
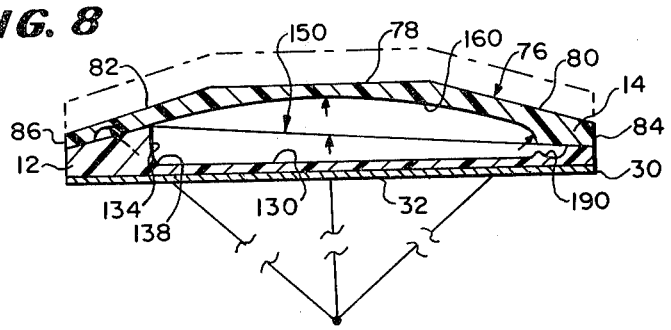
FIG. 8 is a horizontal sectional view of the platen assembly taken along line 8—8 of FIG. 3.

As shown in FIGS. 1 and 4, the outer platen 14 has an upper lip or rim formation 74 extending from a back outer surface 76 thereof. The rim or lip 74 forms a stop for limiting inward movement of the outer platen 14 into the holder 19. Also, as shown in FIGS. 7 and 8 and as is apparent from FIG. 1, the back surface 76 of the outer platen 14 has a back wall portion 78 which is generally parallel to the outer wall surface 32 of the metal plate 30 secured to the inner platen 12 when both platens 12 and 14 are received within the holder 19. Also, the back wall surface 76 includes two inclined wall portions 80 and 82, the portion 80 extending from a first edge 84 of the outer platen 14 to the wall portion 78 and the wall portion 82 extends from a second edge 86 of the outer platen 14 to the wall portion 78.

As shown in FIG. 4 and FIG. 1, the inner surface 72 has a large planar portion 88 and a narrow planar portion 90. Obviously, the planar portion 88 is adapted to rest against the planar portion 58 of the inner platen 12. Likewise the narrow planar portion 90 of the inner surface 72 of the outer platen 14 is adapted to rest against the narrow planar portion 62 of the inner surface 56 of the inner platen 12. The planar inner surface portion 88 extends from the first side edge 84 of the inner platen 14 at a given distance relative to the planar back wall portion 78 and at an angle toward the plane of the back wall portion 78 to a line 92 where the inner surface planar portion 88 is closer to the plane containing the back wall portion 78. From the line 92 the narrow planar inner surface portion 90 extends away from the plane containing the back wall portion 78. In this way, an irregular inner surface 72 is formed which facilitates removal of the bag 16 from the platen assembly after a quantity of whole blood has been centrifuged within a separation chamber formed within the bag 16 and defined by the cavities 60 and 70 and the platen holder and latch assembly 18 is opened to remove the platens 12 and 14 and the bag 16. Also, the inclined planar inner surface portions 58 and 88 result in the cavities 60 and 70 therein having varying depths from one side thereof to the other side thereof. This arrangement minimizes if not altogether obviates the formation of wrinkles in the walls of the bag 16 when they are received in the respective cavities 60 and 70.

The plastic bag/receptacle 16 is formed from two plies of polyvinylchloride material which are sealed together around the margins of the two plies so that a bag is formed therein. Also, the upper margin 94 of the bag 16 is wider and has three punchable holes 95, 96 and 97 therein which are adapted to receive pins 105, 106 and 107 extending from the inner surface 56 of the inner platen 12. As shown, each of the pins 105, 106 and 107 is generally cylindrical with a flat outer surface which facilitates their movement through the punchable holes 95, 96 and 97. Also, the pins 105, 106 and 107 are received in mating openings 115, 116 and 117 in the inner surface 72 of the outer platen 14.

Figure 9:
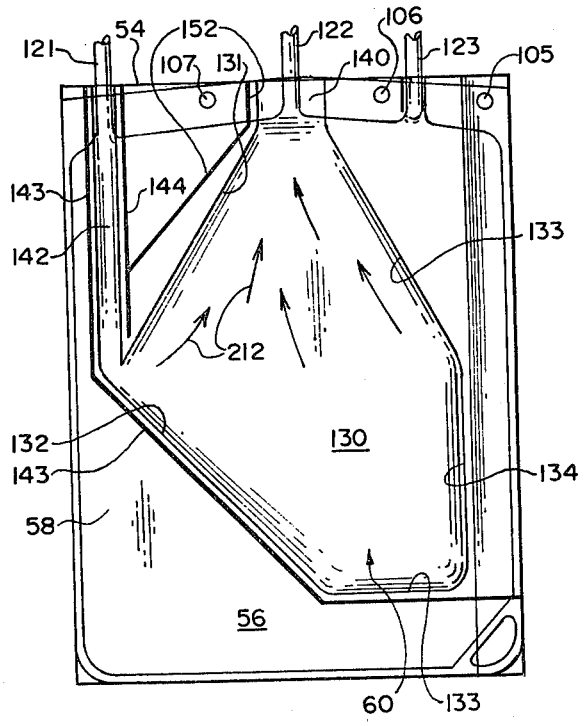
FIG. 9 is a vertical plan view of the inner surface of the inner platen and is taken along line 9—9 of FIG. 7.

As best shown in FIG. 9, the cavity 60 has an inner wall surface 130 which, as shown in FIG. 8, is planar and arranged generally parallel to the outer wall surface 32. The inner wall surface 130 extends laterally within the inner platen 12 between a top and bottom of the cavity 60 and first and second side edges of the cavity 60. The first side edge is defined by an upper inclined edge wall surface portion 131 and a lower inclined edge wall surface portion 132. The second edge of the cavity is defined by an upper inclined edge wall surface portion 133 and a vertically extending lower edge wall surface portion 134. The bottom is defined by a bottom edge wall surface portion 135 which extends between the inclined lower wall portion 132 and the vertically extending lower wall portion 134.

The junction between each of the edge wall surface portion 131–135 with the inner planar wall surface 130 is rounded such as the fillet round 138 between the edge wall surface 134 and the inner wall surface 130 shown in FIG. 8.

The upper portions 131 and 133 of the first and second edge wall surfaces of the cavity 60 are inclined at an angle to a top to bottom center line of the platen 12, such angle being between 20° and 40° and is preferably 30°.

In addition to the cavity 60, the inner platen 12 has an upper recess formation 140 at the top of the cavity 60 and communicating the top of the cavity 60 with the top edge 54 thereof and receives therein the tubing 122 defining the top center port. Also, in the planar portion 58 there is a groove formation 142 which extends from the top edge 54 of the inner platen 12 to the junction between the upper edge wall portion 131 and the lower edge wall portion 132. Adjacent the groove formation 142 are ridges 143 and 144 which crimp a portion of the flexible plastic gas 16 to form a passageway in the bag 16 from the port 121 to a point on the first side edge midway between the top and bottom of the cavity 60 and at the junction between the upper inclined portion 131 and lower inclined portion 132. The ridge 143 continues downwardly adjacent the inclined wall surface portion 132 and then along the inclined wall surface portion 135 across the inner surface 56 to engage and pinch off the plies of the bag 16 to form a separation chamber therein, such separation chamber being identified by the reference numeral 150 in FIG. 8.

Another ridge 152 extends from the ridge 144 and is spaced from the upper inclined wall portion 131. This ridge 152 extends to a point adjacent the recess formation 140 and then upwardly to the top edge 54.

Figure 5:
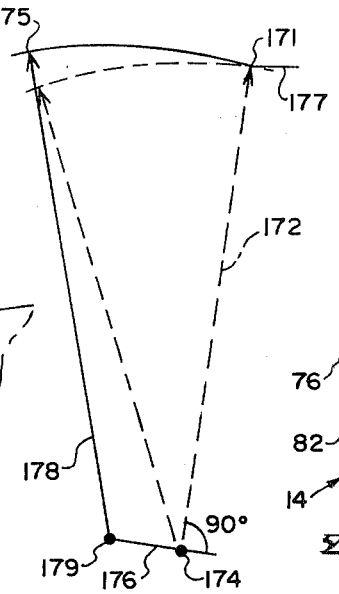
FIG. 5 is a diagram showing the manner in which the curved outer surface of the blood separation chamber in the cavity in the outer platen is defined.
Figure 10:
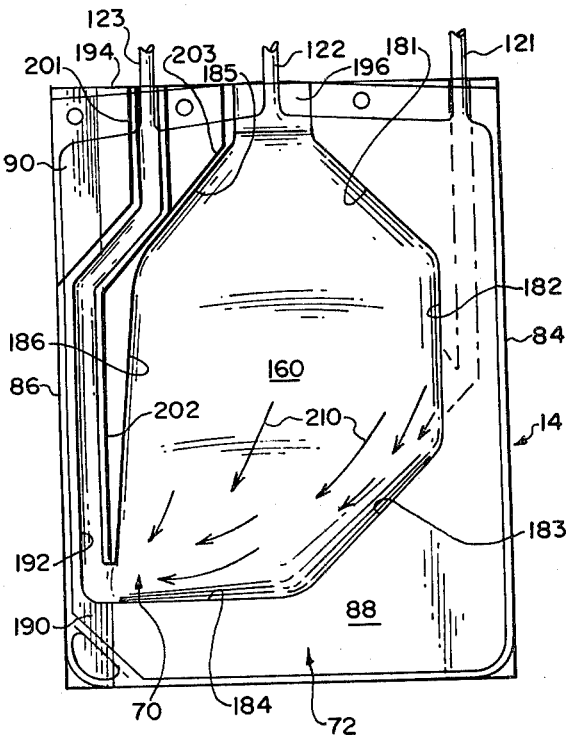
FIG. 10 is a vertical plan view of the inner surface of the outer platen taken along line 10—10 of FIG. 7.

As best shown in FIG. 10, the cavity 70 in the outer platen 14 has a wall surface 160 extending laterally within the platen 14. As shown in FIG. 4, this wall surface 160 is curved from a first side of the cavity 70 to a second side of the cavity 70. Referring to FIG. 5, this curved surface extends in a spiral so that the second side of the cavity 70 is further out from the axis of rotation of the centrifuge device than the first side. The spiral is defined by curves extending from (1) a first point 171 on the curved wall surface 160 at the first edge of the cavity 70, this point being at a given radius 172 from the axis 174 of rotation and to a second point 175 on the wall surface 160 at the second edge thereof, which point 175 is defined first by defining a line 176 extending from and normal to both the given radius 172 and the axis of rotation 174 and extending parallel to a tangent 177 at the point 171 of the given radius 172, and second by extending a second radius 178 having the same length as the radius 172 from a center point 179 on the line 176 displaced from the axis 174 a given distance which is preferably 0.325 inch (0.8 cm).

Also the wall surface 160 which is referred to as outer wall surface 160 of the blood separation chamber 150 is inclined from the bottom to the top thereof. In this respect, a top to bottom center line on the surface 160 forms an angle of approximately 1° with the plane containing the back wall portion 78.

The first side of the cavity 70 is defined by an upper inclined wall surface portion 181, a vertically extending edge wall surface portion 182 and a lower inclined edge wall surface portion 183. The edge wall portion 182 extends between the edge wall portion 181 and 183 and the edge wall portion 183 extends to a bottom wall portion 184 extending generally horizontally.

The second edge of the cavity 70 is defined by an upper inclined wall portion 184 and a lower slightly inclined wall portion 186. The upper inclined edge wall portions 181 and 185 of the first and second edges are inclined at an angle of between 40° and 50° to a top to bottom center line of the platen 14, and preferably at an angle of approximately 45°. The second side edge 186 is inclined slightly from the lower corner thereof upwardly toward the center line and to the upper inclined wall portion 185. The inclined wall portion 183 is preferably at an angle of 45° to the horizontal.

In addition to the cavity 70 the inner surface 72 has a recess 190 therein at the lower corner at the junction between the bottom wall portion 184 and the lower end of the inclined wall portion 186 of the second side of the cavity 70.

Also there is a groove formation 192 in the inner surface 72 which extends from the recess 190 upwardly in the narrow planar portion 90 and then back into the planar portion 88 and upwardly to a top edge 194 of the outer platen 14. The upper portion of the groove formation 192 receives the tubing 123 therein and serves to form a passageway from the tubing 123 to the recess 190 at the lower corner of the cavity 70. The recess 190 is the furthermost point from the axis of rotation 174.

Also, the outer platen 14, as best shown in FIG. 4, has a boss 196 at the top thereof which mates with the recess formation 140 for forming an outlet passageway for the outlet port 122.

As best shown in FIG. 6, the platen assembly 10 is positioned within the centrifuge device such that a side to side vertical plane extending therethrough extends at an angle of between 83° to 89.5° to a radius such as radius 172 extending outwardly from the axis of rotation 174. Preferably, this angle is 89°. As a result, the planar inner surface 130 will be at an angle of 89° to the radius 172 and since the curved surface 160 is already at an angle of 1°, it will be at an angle of 88° to the radius 172.

To assist in crimping the plies of material forming the bag 16 into a desired configuration for forming the separation chamber 150, the inner surface 72 of the platen 14 has a ridge 201 extending downwardly from the upper edge 194 along the groove formation 192 to the second edge 86 of the platen 14. Another ridge 202 extends upwardly from the recess 190 along the other side of the groove formation 192 to the top edge 194. Another ridge 203 extends from the ridge 202 along the inclined wall portion 185 to the boss 196 and then up to the top edge 194 of the platen 14.

With the platens 12 and 14 formed with the cavities 60 and 70 therein and the bag 16 clamped therebetween as described above, whole blood is received through the port 121 and directed through the passageway formed by the groove formation 142 to the first side of the whole blood separation chamber 150 formed in the bag 16 at a point midway between the top and bottom thereof and then because of the incline of the wall surfaces 130 and 160, the red blood cells are directed downwardly and outwardly toward the recess 190 at the lower corner of the cavity 70 as indicated by the arrows 210 in FIG. 10. This is particularly because the curved wall surface 160 extends outwardly and downwardly from the axis of rotation 174.

In the meantime, the plasma from the whole blood which is lighter than the red blood cells will move toward the shortest radius which is at a top to bottom center line on the inner wall surface 130 including the outlet port 122. Accordingly, plasma and white blood cells will move in the direction indicated by the arrows 212 in FIG. 9.

From empirical tests with different configurations of the edge wall surface portions of the cavities 60 and 70 and of the inner and outer wall surfaces 130 and 160, it has been found that cavities 60 and 70 configured in the manner described above to form the blood separation chamber 150 in the bag 16 enhance the separation of granulocytes from the whole blood centrifuged within the blood separation chamber 150 with such granulocytes flowing in the direction indicated by the arrows 212.

This enhanced separation of granulocytes from whole blood has resulted in an increase of separation of roughly 15% separation to roughly 65% separation of granulocytes from whole blood.

The separation is also achieved by reason of the centrifuging of the blood within the chanber along the lines disclosed in U.S. Pat. No. 4,185,629 referred to above. More specifically, the whole blood is subjected to G forces between 100 and 200 G's and preferably 145 G's. The separation chamber is arranged at a radius of from 4 to 6 inches (10–16 cm) from the axis of rotation 174 and preferably at 5.12 inches (13 cm). The centrifuge is then rotated at a speed of between 500 l to 1500 RPM and preferably at 1000 RPM.

In the pumping of whole blood into the plasma out of the blood separation chamber 150, whole blood is pumped into the chamber at a rate of 50 ml. per minute. Plasma is withdrawn from the outlet 122 at a rate of between 18 and 28 ml per minute.

In operating the centrifuge device with the platen assembly 10 therein to effect separation of granulocytes from whole blood the chamber 150 is first filled with a priming solution and the priming solution is withdrawn from the chamber at a rate of 45 ml per minute while whole blood is being pumped into the chamber at a rate of 50 ml per minute. This is done until red blood cells are withdrawn with the plasma from the outlet 122 at which time the optical density of the plasma goes above 0.5. Then the plasma pump is slowed or reduced to maintain a predetermined quantity of plasma with red blood cells being transferred from the chamber 150. Then, the rate of withdrawal of plasma is increased from between 0.125 and 0.25 ml per minute every 35 seconds until the optical density of the plasma being withdrawn exceeds 0.5 optical density units. At this time the flow of plasma is slowed or reduced to maintain a predetermined amount of plasma with red blood cells being transferred from the chamber 150. Then the procedure of increasing the rate of withdrawal every 35 seconds is repeated until an increased spillover of red blood cells is sensed and then the steps described above are repeated. This method is continued until a predetermined quantity, such as 3 liters of blood, has been processed.

By providing a greater converging angle between walls 131,133 on the inner or lower G platen 12 and a line parallel to the axis of rotation than is provided between walls 181,185 on the outer or high G platen 14, a greater acceleration of lighter components through exit port or passage 122 is achieved. These lighter components would be, for example, plasma including granulocytes. This beneficial result will be obtained by configuring the respective platens 12, 14 so that the angle between wall portions 131,133 and an intersecting line parallel to the axis of rotation is less than the angle between wall portions 181,185 and an intersecting line parallel to the axis of rotation.

From the foregoing description it will be appreciated that the method and chamber of the present invention for separating granulocytes from whole blood have a number of advantages some of which have been described above and others of which are inherent in the invention.

We claim:

1. A method for separating whole blood into the components thereof within a separation chamber mounted in a centrifuge device during centrifugation of the chamber, the chamber having inner and outer wall surface and first and second side edges, said method comprising the steps of arranging and configuring the chamber such that it has (a) an inlet on the first side thereof through which whole blood is received, (b) a first upper outlet at the top of the chamber from which plasma with particles therein is withdrawn, (c) a second lower outlet at the bottom corner of the chamber on the second side thereof from which red blood cells are withdrawn, and (d) the inner wall surface positioned in a plane including a tangent to a circle about the axis of rotation and the plane positioned about normal (in a vertical direction) to a radius extending from the axis of rotation of the centrifuge device; directing whole blood into the chamber from the first side thereof at a point between the bottom and top of the chamber; directing heavier particles such as red blood cells downwardly and outwardly along the outer wall surface toward the lower bottom corner of the chamber; and directing plasma upwardly along the inner wall surface of the chamber, so that there is separation of white blood cells, particularly granulocytes, from the whole blood, which are directed with the plasma, toward and out the first outlet from the chamber.

2. The method according to claim 1 wherein said step of directing plasma upwardly is achieved, in part, by directing the plasma adjacent the upper portion of the inner wall surface in a converging direction established by first and second upper side edge portions of the chamber adjacent the inner surface, which upper side edge portions converge toward said first upper outlet.

3. The method according to claim 2 wherein the upper converging side edge portions adjacent the upper portion of the inner surface are each situated, respectively on a line which intersects a top to bottom center line of the inner wall surface at an angle of from 15° and 40°.

4. The method according to claim 3 wherein said angle is approximately 30°.

5. The method according to claim 1 wherein said plane about normal to the radius is at an angle of between 83° and 89.5° to the radius.

6. The method according to claim 5 wherein said angle is between 88° to 89°.

7. The method according to claim 5 wherein said angle is approximately 89°.

8. The method according to claim 1 wherein said step of directing red blood cells outwardly is achieved by making the outer wall surface extend in a spiral from the first side thereof to the second side thereof.

9. The method according to claim 8 wherein said spiral surface is defined by curves extending from (1) a first point on said outer wall surface at said first side edge, said point being at a given radius from the axis, and (2) a second point on the outer wall surface at said second side edge which is defined first by defining a line from and normal to both the radius and the axis and extending parallel to a tangent at the given radius and second by extending a second radius having the same length as the given radius to said second point from a center point on said line displaced from said axis a given distance.

10. The method according to claim 9 wherein said given distance is approximately 0.325 inch (0.8 cm).

11. The method according to claim 10 wherien said angle is approximately 88°.

12. The method according to claim 1 wherein said step of directing the red blood cells downwardly along the outer wall surface of the chamber is achieved in part by positioning the outer wall surface on lines each extending in the vertical direction at an angle of from 83° to 89.5° to a radius extending from the axis of rotation.

13. The method according to claim 1 wherein said whole blood is directed into said chamber at a point approximately midway between the top and bottom thereof.

14. The method according to claim 1 wherein whole blood is directed into said chamber adjacent said inner wall surface along a lower inclined portion of said first side edge of said chamber.

15. The method according to claim 14 wherein said lower inclined portion of sid first side edge adjacent the inner wall surface is arranged at an angle of approximately 45° to the horizontal.

16. The method according to claim 1 wherein whole blood is directed into said chamber adjacent said outer wall surface along a lower inclined portion of said first side edge of said chamber.

17. The method according to claim 16 wherein said lower inclined portion of said first side edge adjacent the outer wall surface is arranged at an angle of approximately 45° to the horizontal.

18. The method according to claim 1 wherein upper portions of the first and second side edges adjacent the outer wall surface are arranged to be inclined toward the first upper outlet on respective lines which intersect a vertical centerline therebetween at an angle of from 40° to 50°.

19. The method according to claim 18 wherein said angle is approximately 45°.

20. The method according to claim 18 wherein the first side edge adjacent said outer wall surface is defined by said upper inclined portion, a lower inclined portion and a generally vertically extending edge portion between said upper inclined portion and said lower inclined portion.

21. The method according to claim 18 wherein said second side edge is defined by the upper edge portion and a lower portion which extends from the lower bottom cover upwardly at a slight angle toward a top to bottom centerline of said outer wall surface to the inclined upper edge portion.

22. The method according to claim 1 wherein said separation chamber is subjected to a centrifugal force of between 100 and 200 G's.

23. The method according to claim 22 wherein said centrifugal force is approximately 145 G's.

24. The method according to claim 1 wherein said separation chamber is arranged at a radius of from 4 to 6 inches (10–16 centimeters) from the axis of rotation.

25. The method according to claim 24 wherein said radius is approximately 5.12 inches (13 centimeters).

26. The method according to claim 1 wherein said chamber is rotated at a speed of between 500 and 1500 RPM.

27. The method according to claim 1 wherein said chamber is rotated at a speed of approximately 1000 RPM.

28. The method according to claim 1 wherein whole blood is pumped into the chamber at a rate of 50 milliliters per minute.

29. The method according to claim 1 wherein plasma is withdrawn from the chamber at a rate of between 18 and 28 milliliters per minute.

30. The method according to claim 1 wherein said chamber is first filled with a priming solution and the priming solution is withdrawn from the chamber at a rate of 45 milliliters per minute while whole blood is being pumped into the chamber at a rate of 50 milliliters per minute until red blood cells are withdrawn with plasma from the first upper outlet to such an extent that the optical density of the plasma exceeds 0.5 optical density units at which time the withdrawal of plasma is reduced to maintain a predetermined quantity of plasma with red blood cells therein flowing from said chamber.

31. The method according to claim 30 wherein the rate of withdrawal of plasma is increased from between 0.125 and 0.25 milliliters per minute every 35 seconds until the optical density of the plasma being withdrawn exceeds 0.5 optical density units at which time the flow of plasma is reduced to maintain a predetermined amount of plasma with red blood cells therein flowing from the chamber and the procedure of increasing the rate of withdrawal every 35 seconds in the manner described above is repeated until the optical density of the plasma being withdrawn again exceeds 0.5 optical density units at which time the procedure is repeated until a predetermined quantity of whole blood has been processed.

32. A flexible generally rectangular bag formed from two plies of flexible material sealed around the edges thereof for receiving whole blood therein for separation of the whole blood into components thereof when said flexible bag is received and clamped between two platens of a platen assembly and rotated therewith in a centrifuge device with each platen having a cavity therein configured to mate with the cavity in the other platen to define together a blood separation chamber in said bag, said flexible bag having a top side port in the top edge adjacent one side edge with a tubing extending therefrom which functions as an exit port for red blood cells, a top central port in the top edge with a tubing extending therefrom forming an exit port for plasma and white cells, and a top mid-central port in the top edge on the other side of the top center port with a tubing extending therefrom which functions as an inlet port for whole blood, a first passageway formed between said two plies as a result of at least one ply being received in a first groove formation in one platen extending between said top mid-central port and a point between the bottom and top of the separation chamber formed within said bag so that whole blood entering into said top mid-central port and first passageway is directed by said first passageway into the separation chamber within the bag at one side of said chamber and between the top and bottom of said chamber, a second passageway formed betwen said two plies as a result of at least one ply being received in a second groove formation formed in one platen and extending between said top side port and a bottom corner of said separation chamber on the other side of said chamber so that red blod cells directed to the lower corner exit out the second passageway and said top side port, said plies of said bag being movable into said cavities to form a separation chamber having the configuration of said cavities by the pressure of whole blood pumped into the separation chamber as the chamber is being rotated to subject the whole blood therein to centrifugal force, the configuration and orientation of the separation chamber formed within the bag serving to separate plasma and white cells from the red cells within said bag, and said bag being disposable such that the mating cavities defining the separation chamber in the bag clamped therebetween can be quickly reused without special cleaning thereof.

33. The bag according to claim 32 being made of two plies of polyvinylchloride material.

34. Blood processing means for receiving whole blood therein for the centrifugation of the blood therein to effect separation of the blood into components thereof, said means being positionable within a centrifuge device on a tangent of a circle about the axis of rotation of the device and releasably fixed in that position for rotation about the axis, said means having a blood separation chamber therein situated between an inner wall surface and an outer wall surface of said chamber and between a top and bottom and first and second side edges of said chamber, said inner wall surface facing away from the axis and being in a plane which is generally tangent to circles about the axis and which extends upwardly from a bottom tangent line at a first radius toward the axis of rotation at a slight angle to said first radius, said outer wall surface being generally parallel spaced from and facing said inner wall surface, inlet port means for directing whole blood into said chamber at a point on said first side edge thereof between the top and bottom of said chamber, first outlet port means opening into said chamber at the top of said chamber for the withdrawal of plasma from said chamber and second outlet port means opening into said chamber at a bottom corner thereof at the bottom of said second side edge of said chamber, said outer wall surface being configured and arranged to direct heavier particles, such as red blood cells, outwardly from said first side edge to said second side edge and simultaneously downwardly toward said lower bottom corner during rotation of said chamber about the axis so that such heavier particles can be withdrawn out of said second outlet means, and the upper portions of said first and second side edges adjacent said inner wall surface being configured to converge toward said first outlet means to direct plasma out of said chamber and thereby obtain separation of white blood cells, particularly granulocytes, from the whole blood, which are directed with the plasma toward and out said first outlet means from said chamber.

35. The blood processing means according to claim 34 wherein said upper converging side edge portions adjacent the upper portion of said inner surface are each situated, respectively, on a line which intersects a top to bottom center line on said inner wall surface at an angle between 15° and 40°.

36. The blood processing means according to claim 35 wherein said angle is approximately 30°.

37. The blood processing means according to claim 34 wherein said plane of said inner surface is at an angle of between 83° and 89.5° to said first radius.

38. The blood processing means according to claim 37 wherein said angle is between 88° and 89°.

39. The blood processing means according to claim 37 wherein said angle is approximately 89°.

40. The blood processing means according to claim 34 wherein said outer wall surface extends from said first side edge of said chamber in a spiral to said second side edge of said chamber.

41. The blood processing means according to claim 40 wherein said spiral outer wall surface is defined by curves extending from (1) a first point on said outer wall surface at said first side edge, said point being at a given radius from the axis, and (2) a second point on said outer wall surface at said second side edge which point is defined first by defining a line from and normal to both the given radius and the axis and extending parallel to a tangent at the given radius, and second by extending a second radius having the same length as the given radius to said second point from a center point on said line displaced from said axis a given distance.

42. The blood processing means according to claim 41 wherein said given distance is approximately 0.325 inch (0.8 cm).

43. The blood processing means according to claim 34 wherein said outer wall surface of said chamber is defined by lines each extending in the vertical direction at an angle of from 83° to 89.5° to said first radius extending from the axis of rotation.

44. The blood processing means according to claim 43 wherein said angle is approximately 88°.

45. The blood processing means according to claim 34 wherein said inlet port means opens into said chamber at said first edge thereof approximately midway between the top and bottom of said chamber.

46. The blood processing means according to claim 34 wherein a portion of said first side edge adjacent said inner wall surface and extending to the bottom of said chamber is inclined from said inlet port means to the bottom of said chamber.

47. The blood processing means according to claim 46 wherein said lower inclined portion of said first side edge adjacent said inner wall surface is at an angle of approximately 45° to the horizontal.

48. The blood processing means according to claim 34 wherein a portion of said first edge beneath said inlet port means and adjacent said outer wall surface is inclined and extends to the bottom of said chamber.

49. The blood processing means according to claim 48 wherein said lower inclined portion of said first side edge adjacent said outer wall surface is at an angle of approximately 45° to the horizontal.

50. The blood processing means according to claim 34 wherein the upper portions of said first and second side edges adjacent said outer wall surface are inclined toward said first outlet means on respective lines which intersect a vertical center line on said outer wall surface at an angle of from 40° to 50°.

51. The blood processing means according to claim 50 wherein said angle is approximately 45°.

52. The blood processing means according to claim 50 wherein said first side edge adjacent said outer wall surface is defined by said upper inclined portion, a lower inclined portion and a generally vertically extending portion between said upper inclined portion and said lower inclined portion.

53. The blood processing means according to claim 50 wherein said second side edge is defined by said upper edge portion and a lower portion which extends from the bottom corner of said chamber outwardly at a slight angle toward a top to bottom center line of said outer wall surface to said upper inclined edge portion adjacent said outer wall surface.

54. The blood processing apparatus according to claim 34 comprising a platen assembly including an inner platen, an outer platen and a flexible receptacle formed of two plies of flexible material clamped therebetween, said outer platen having a first inner surface which faces toward the axis and which has a first cavity therein having said outer wall surface therein extending between a first side edge and a second side edge and a top and a bottom of said first cavity, first and second side edge portions converging toward each other and the top of said cavity, a short bottom edge portion and an inclined edge portion extending from said bottom edge portion to said first edge, an outlet port-forming groove formation in said inner surface between a top edge of said outer platen to a bottom corner of said cavity at the junction of said bottom edge portion and said second side edge, said inner platen having a second inner surface facing away from the axis and having a second cavity therein which is adapted to mate with said first cavity and which has therein said inner wall surface extending between diverging inclined upper first and second side edge portions, a bottom edge, an inclined lower first side edge portion extending from said upper first side edge portion to said bottom edge portion, and a top exit port-forming recess formation in said second inner surface between the top edge of said inner platen and the top of said second cavity, an inlet port-forming groove formation in said second inner surface extending from the top edge of said inner platen to the junction between said upper and lower first side edge portions, said outer and inner platens clamping said flexible receptacle therebetween to form said blood separation chamber therein with said respective first and second cavities in said respective platens configuring said chamber so that whole blood is received into the chamber through an inlet port passageway formed between said plies of material by reason of one ply being received in said inlet port-forming groove formation in said second inner surface of said inner platen and into said chamber at a point between the top and bottom of said chamber and such that during centrifugation, red blood cells are directed toward the lower outer corner of the chamber at about the junction of said bottom edge and said second side edge of said first cavity in said first inner surface of said outer platen so that red cells can be withdrawn through an outlet port passageway formed between said plies of material by reason of one ply being received in said outlet port-forming groove formation in said inner surface of said outer platen and plasma carrying white cells, particularly granulocytes, is directed by the upper first and second side edge portions of said second cavity in said second inner surface in said inner platen out of a top outlet port defined by said top-exit forming recess formation in said inner platen.

55. The blood processing means according to claim 54 wherein said inner platen has a planar back wall surface facing the axis and said second inner surface of said inner platen is non-parallel to said planar back wall surface such that said second inner surface extends from a first side edge of said inner platen at a given distance from said back wall surface to a line spaced from said back wall surface a distance greater than said given distance and wherein said inner platen has a narrow wall surface extending from said second inner surface to said second side edge of said inner platen in a plane inclined toward the plane of said back wall surface so that said second cavity is deeper on the second side thereof than on the first side thereof with said inner wall surface in said second cavity lying in a plane parallel spaced from the plane of said back wall surface.

56. The blood processing means according to claim 55 wherein said second inner surface of said inner platen has ridges thereon along and on either side of said inlet port forming groove formation, adjacent the inclined lower portion of said first side edge and across said second inner surface adjacent the bottom of said second cavity and across said narrow wall surface and a ridge extending from the ridge on one side of said groove formation upwardly along said upper first side edge portion of said second cavity and then to the top edge of said inner platen, said ridges serving to pinch off and clamp portions of said flexible receptacle therebetween.

57. The blood processing means according to claim 55 wherein said outer platen has a back wall surface portion generally parallel to said planar back wall surface of said inner platen and wherein said first inner surface of said outer platen is in a plane non-parallel to said back wall surface portion so as to mate with said second inner surface of said inner platen and has a narrow wall surface extending from said second inner surface in a direction away from said back wall surface portion to an edge of said outer platen.

58. The blood processing means according to claim 57 wherein a recess is provided in said first inner surface of said outer platen at said lower corner of said first cavity and communicates said first cavity with said groove formation.

59. The blood processing means according to claim 57 wherein said first inner surface of said outer platen has a ridge thereon extending along said groove formation from the top edge of said outer platen to the second side edge of the outer platen and a ridge extending between said groove formation and said slightly inclined portion of said second edge of said first cavity to said recess and wherein said first inner surface has a boss formation extending outwardly therefrom adjacent the top thereof and being adapted to be received in and mate with said exit port recess formation in said second inner surface of said platen.

60. The blood processing means according to claim 54 wherein said inner platen has three cylindrical pins extending from the second inner surface thereof adjacent the top edge of said inner platen, each cylindrical pin having a flat outer surface, wherein said outer platen has three openings in said first inner surface thereof adapted to receive said three pins extending from said second inner surface of said inner platen, and wherein said flexible receptacle has three punchable holes therein which are adapted to mate with and have received therein said three pins for aligning and holding said flexible receptacle between said inner and outer platens when it is clamped therebetween.

61. For use in a platen assembly of the type which includes an inner platen, an outer platen and a flexible receptacle clamped therebetween and which is positionable on a tangent in a centrifuge device and releasably fixed in that position for rotation about the axis of rotation of the device, an outer platen having an inner surface which faces toward the axis, said inner surface having a cavity therein which has first and second side edges and a curved wall surface extending from said first edge into said platen and to said second side edge and having a top and a bottom, said cavity being configured, when a wall of a flexible receptacle is positioned thereagainst, to direct whole blood entering the receptacle into said cavity within the receptacle at a point on said first side edge of said cavity between said top and bottom thereof and to direct red blood cells toward a lower corner to said cavity at the junction between said bottom and said lower end of said second side edge of said cavity.

62. The outer platen according to claim 61 wherein said wall surface of said cavity is defined by lines each extending in the vertical direction at an angle of approximately 1° to the plane of said outer platen.

63. The outer platen according to claim 61 wherein said wall surface of said cavity is positioned in the centrifuge device so as to have lines thereon each extending in a vertical direction at an angle of approximately 88° to a radius from the axis of rotation of the centrifuge device.

64. The outer platen according to claim 61 wherein said wall surface extends from said first side edge of said cavity in a spiral to said second side edge of said cavity.

65. The outer platen according to claim 64 wherein said spiral wall surface is defined by curves extending from (1) a first point on said wall surface at said first side edge, said point being at a given radius from the axis, and (2) a second point on said wall surface at said second side edge which second point is defined first by defining a line from and normal to both the given radius and the axis and extending parallel to a tangent at the given radius, and second by extending a second radius having the same length as the given radius to said second point from a center point on said line displaced from said axis a given distance.

66. The outer platen according to claim 65 wherein said given distance is approximately 0.325 inch (0.8 cm).

67. The outer platen according to claim 61 wherein said cavity includes an inclined edge portion extending between a generally vertical edge portion of said first side edge and the bottom side of said cavity and wherein said bottom side is defined by a bottom edge wall surface extending into said platen from said inner surface thereof to said curved wall surface and the junction between said inclined edge portion and said bottom edge wall surface being rounded.

68. The outer platen according to claim 67 wherein said bottom edge wall surface extends from said inclined edge portion to said second side edge of said cavity and wherein the junctions between said bottom edge wall surface and said curved wall surface and between said inclined wall portion and said curved wall surface are rounded.

69. The outer platen according to claim 61 having a recess at said lower corner thereof communicating with said cavity and a groove formation in said inner wall surface of said platen communicating with said recess and extending upwardly from said bottom corner to the top edge of said platen.

70. The outer platen according to claim 69 having ridges on the inner surface thereof adjacent the upper portion of said groove formation with one of said ridges extending downwardly between said groove formation and said second edge of said cavity to said recess.

71. The outer platen according to claim 61 wherein the upper portion of said first and second side edges of said cavity are inclined toward a top to bottom center line of said cavity on respective lines which intersect said top to bottom center line at an angle of from 40° to 50° and said cavity being further defined by edge wall surfaces which extend into said platen from said inner surface at said upper portions of said first and second side edges.

72. The outer platen according to claim 61 wherein said inner surface is non-parallel to the plane containing the tangent on which the platen assembly is situated.

73. For use in a platen assembly of the type which includes an inner platen, an outer platen and a flexible receptacle clamped therebetween and which is positionable on a tangent of a circle in a centrifuge device and releasably fixed in that position for rotation about the axis of rotation of the device, an inner platen having an inner surface which faces away from the axis, said inner surface having a cavity therein which has a top and a bottom and first and second side edges, and a planar surface extending between said top and bottom and said side edges, the upper portion of said first and second side edges of said cavity converging toward the top of said cavity which has a recess formation therein forming an outlet from said cavity so that such converging upper portions of said first and second side edges, when a wall of a flexible receptacle is received within said cavity, will serve to direct and facilitate flow of plasma carrying white blood cells, particularly granulocytes, upwardly to the top of said cavity.

74. The inner platen according to claim 73 wherein said wall surface of said cavity is positionable within the centrifuge device so as to form an angle of approximately 89° with a radius from the axis of rotation.

75. The inner platen according to claim 73 wherein a lower portion of said first side edge extends at an incline to the bottom of said cavity from said upper portion of said first side edge.

76. The inner platen according to claim 75 wherein said lower inclined portion of said first side edge is at an angle of approximately 45° to the horizontal.

77. The inner platen according to claim 76 wherein said inner surface of said inner platen has a groove formation therein which extends from the top edge of said inner platen to the junction between the upper and lower inclined portions of said first edge of said cavity and communicates with said cavity at that point.

78. The inner platen according to claim 77 wherein said inner surface has ridges thereon which extend adjacent each side of said groove formation and a ridge extending upwardly from a ridge between said groove formation and said upper portion of said first edge and spaced from said first edge to an upper recess formation at the top of said cavity and then upwardly to the top edge of said inner platen and a ridge extending from the ridge on the outside of said groove formation downwardly along the lower inclined portion of said first edge and then adjacent the bottom of said cavity to the other side of said inner platen on said inner surface.

79. The inner platen according to claim 73 wherein said inner surface is non-parallel to a plane containing the tangent on which the platen assembly is positioned.

* * * * *